US005182838A

United States Patent [19]

Stenner

[11] Patent Number: 5,182,838

[45] Date of Patent: Feb. 2, 1993

[54] FILAMENT, CORDAGE LOCKING DEVICE

[76] Inventor: John R. Stenner, 375 Bates Ave., Boulder, Colo. 80303

[21] Appl. No.: 744,445

[22] Filed: Aug. 13, 1991

[51] Int. Cl.[5] ..... A43C 7/00

[52] U.S. Cl. ..... 24/712.7; 24/129 D

[58] Field of Search ..... 24/712.7, 712.5, 712.1, 24/129 D, 545, 555, 30.55, 115 H, 129 R

[56] References Cited

U.S. PATENT DOCUMENTS

| | | | |
|---|---|---|---|
| 647,824 | 4/1900 | Girtanner . | |
| 675,152 | 5/1901 | Frey | 24/712.7 |
| 899,888 | 9/1908 | Munsell | 24/712.5 |
| 1,146,934 | 7/1915 | Gleeson . | |
| 1,907,629 | 5/1933 | Waltz | 24/115 H |
| 2,200,895 | 5/1940 | Rio . | |
| 2,519,987 | 8/1950 | Wernette . | |
| 3,043,902 | 7/1962 | Klein | 24/129 R X |
| 3,114,950 | 12/1963 | Sellman . | |
| 3,176,362 | 4/1965 | Tames . | |
| 3,257,695 | 6/1966 | Frame . | |
| 3,772,734 | 11/1973 | Kimel . | |
| 3,852,702 | 12/1974 | Dowling . | |
| 3,983,602 | 10/1976 | Barry . | |
| 4,261,081 | 4/1981 | Lott . | |
| 4,357,740 | 11/1982 | Brown . | |
| 4,453,292 | 6/1984 | Bakker . | |
| 4,553,293 | 11/1985 | Blum . | |
| 4,622,723 | 11/1986 | Krauss . | |
| 4,646,394 | 3/1987 | Krauss . | |
| 4,769,874 | 9/1988 | Tracy | 24/129 R |
| 4,805,270 | 2/1989 | Kimbrough . | |
| 4,839,946 | 6/1989 | Murai . | |
| 4,852,223 | 8/1989 | McCreary | 24/712.7 |
| 4,901,402 | 2/1990 | Begemann | 24/545 X |
| 4,967,454 | 11/1991 | Elieff . | |
| 5,063,645 | 11/1991 | Crespo | 24/562 X |

*Primary Examiner*—James R. Brittain
*Attorney, Agent, or Firm*—John R. Flanagan

[57] ABSTRACT

A cord lock of unitary construction comprising a body of resilient material and a slit through the center thereof that defines two cord gripping surfaces. A cord or cords threaded through the slit are securely engaged by a clamping effect at the slit and surface friction between the cords and the gripping surfaces of the slit. The clamping effect results from pressure being applied to the base of the cord lock by the article to which the cords are attached. One releases the cords by squeezing with the fingers the exterior sides of the cord lock body, which are perpendicular to the slit. This causes the slit to pucker and thus spread the slit walls. A hollow section in the base of the body allows the slit to open and release the cords when pressure is applied with the fingers to the base of the cord lock. The gripping surfaces of the slit can be modified to improve their cord-gripping or durability properties to meet specific cord-locking applications. The exterior surface can be molded into any shape or color to meet certain cord locking applications and/or visual market appeal.

20 Claims, 5 Drawing Sheets

FILAMENT, CORDAGE LOCKING DEVICE

BACKGROUND—FIELD OF THE INVENTION

This invention relates to buckles, buttons, clasps, etc., and more specifically to cord locks.

BACKGROUND—DISCUSSION OF THE PRIOR ART

Cords, strings, or other filaments are often used to close or tighten the open ends of various articles. For example, shoelaces are used to secure a shoe to a person's foot, and cords are threaded through a sewn flap around the circumference of bags, jacket hoods, etc., which can in turn be pulled to restrict or entirely close the opening of the article. In all of these examples the movement of the cord must be restricted either by blocking it or by securing two or more cords to each other.

Originally these cords were secured by tying knots in them to block their travel distance or by tying their ends together. Tying, however, can be a troublesome, time-consuming process, especially if the filaments are small or the person has limited finger dexterity. Additionally, it can be very difficult to get proper cord tension when tying. For example, in shoe applications a person must relax the tension on the shoelaces after pulling them tight in order to tie the knot. This allows the shoe a change to loosen up before the knot is completed. This can be a real problem with athletic shoes, especially court shoes, where tight lace tension is essential to proper shoe performance and the prevention of foot and ankle injuries. Furthermore, the tying method does not allow article tension to be easily adjusted. For example, shoe leather stretches and becomes more pliable when it warms up and stress is applied to it from foot movement. This causes the shoe to become loose even though the laces have not been loosened. Now it becomes an onerous task to untie the shoes, tighten the laces and then retie the laces, especially if a double knot was used as is often done in athletic shoe applications.

Various devices have been developed to alleviate the associated problems with tying cords. All current devices for securing cords can be classified into two types: mechanical devices and unitary devices. Mechanical devices require several parts to interact to create the cord locking effect of the device. This type of device incurs additional manufacturing expense due to the need for multiple parts and their assembly, and such devices are prone to wear and failure because of the interaction of their parts. Furthermore, the most popular commercial cord locks of this type are not very effective at securing cords in a lasting manner. For example, the shoelaces of a shoe will slowly slip through the device as the shoe is being used which allows the shoe to become loose.

The second type, unitary devices, are fabricated in one piece with one material which is usually a resilient plastic. The locking effect is the result of the device's physical configuration and material properties working together. Such inventions have been developed for applications ranging from cord locks and clips, to implement holders for safety helmets. The closest integral cord lock to the proposed invention, U.S. Pat. No. 4,646,394 issued on Mar. 3, 1987 to Mark J. Krauss, has jaws articulating with a base. While this device is simple and inexpensive to produce, the articulating joints are prone to wear, and the jaws can be difficult to separate in very tight locking situations. Furthermore, this device is not tactilely or aesthetically pleasing.

Another similar invention, U.S. Pat. No. 4,357,740 issued on Nov. 9, 1982 to Theodore G. Brown, was designed for sealing thin films, such as plastic bags. Although this device does not speak specifically to being a cord lock, a twisted plastic bag could be construed to be a single filament. While this invention does not have jaws, it requires a series of slits in a concave shell to form prongs that define the film engaging surface. These prongs will then release the bag when the base of the shell is squeezed. While this works fine for thin films, it would not work well for tight cords, due to the fact that the cords would slip into the slits, bind the prongs, and cause the device to become nonfunctional. This device is also not tactilely or aesthetically pleasing.

ADVANTAGES

In view of the above, an objective of the present invention is to provide a cord lock device which will securely lock one, two, or more cords.

The following list describes several of the advantages of the present invention:

(a) a cord lock that will be very easy to use and will allow shoes, bags, etc. to be quickly secured;

(b) a cord lock that will allow shoes, bags, etc. to be quickly adjusted while those items are in use;

(c) a cord lock that will not allow cords to slip during use;

(d) a cord lock of unitary or integral construction for the purpose of minimizing production costs;

(e) a durable cord lock due to the absence of hinges or joints thus minimizing wear points;

(f) a cord lock which is flexible and comfortable to the finger's touch;

(g) a cord lock which can be brightly colored;

(h) a cord lock which can be molded into logos or figurines;

(i) a cord lock which can be sewn to fabric to provide unique cord locking applications.

Further advantages will become apparent from a consideration of the ensuing description and drawings of my invention.

DESCRIPTION OF THE DRAWINGS

In the drawings, cross-section figures have the same figure number but different alphabetic suffixes of the perspective figure they are revealing. The alphabetic suffixes correspond to the cross-section line in the perspective drawing.

REFERENCE NUMERALS IN DRAWINGS

Figure 1:
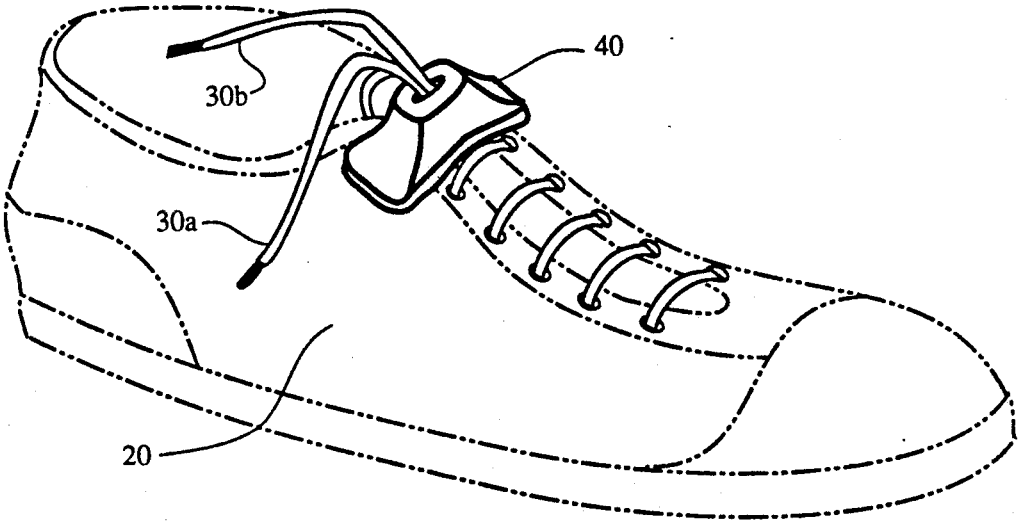
FIG. 1—Top perspective showing a shoe to which the cord lock is applied.

In the drawing, closely related parts are identified with the same number but different alphabetic suffixes.

| | | | |
|---|---|---|---|
| 20 | shoe | 70 | top exterior surface |
| 30a | right end of shoelace | 72a | front exterior side wall |
| 30b | left end of shoelace | 72b | rear exterior side wall |
| 40 | cord lock | 74a | right exterior end wall |
| 50 | slit in the cord lock | 74b | left exterior end wall |
| 52a | front side wall of the slit | 76 | bottom exterior side of base |
| 52b | rear side wall of the slit | 152a | front slit side wall with teeth |
| 54a | right end wall of the slit | 152b | rear slit side wall with teeth |
| 54b | left end wall of the slit | 252a | front slit side wall with laminate |
| 60 | hollow cavity in base | 252b | rear slit side wall with laminate |
| 62a | front side wall of the hollow | 352a | front slit side wall |
| 62b | rear side wall of the hollow | 352b | rear slit side wall |
| 64a | right end wall of the hollow | D | slit displacement vector |
| 64b | left end wall of the hollow | $F_{slit}$ | force vector acting at the slit |
| $\phi g$ | angle of front wall in hollow | P | force vector from shoe towards base of lock |
| $\phi h$ | angle of side wall in hollow | | |
| $F_{sf}$ | surface friction force vector | | |
| $F_{finger}$ | finger force vector | | |

DESCRIPTION OF THE INVENTION

(FIGS. 1, 2, 2A, 2B, 6–11)

In the following description the subject device shall be identified as a cord lock for the sake of simplicity and will be described as engaging one or more shoelace cords. It should, however, be understood that it could be used to engage or interlock other types of filaments.

Referring now to FIG. 1, the subject devices may be used, for example, to hold a shoe, 20, on a person's foot with a shoelace having two lace ends, 30*a* and 30*b*, which are engaged or secured by a cord lock, 40.

Figure 2:
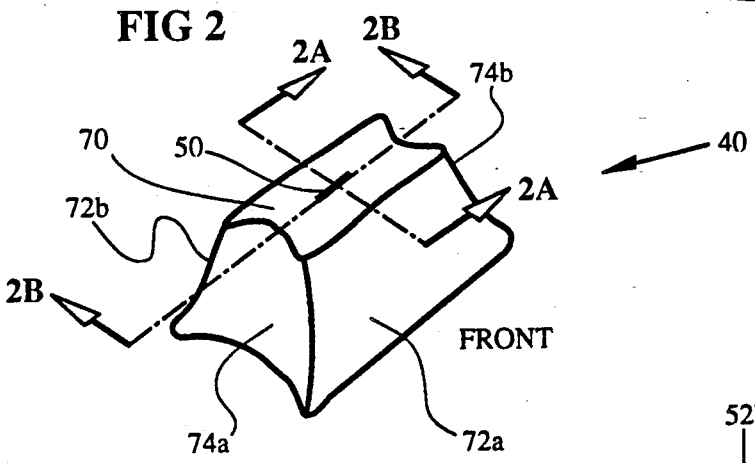
FIG. 2—Top perspective showing the normal unstressed state of the cord lock and the slit.

FIG. 2 shows a preferred version of the cord lock body 40, in its normal unstressed state. The slit 50 defines an elongated passageway surrounded by the solid interior of the body of the cord lock, through which the cords are threaded. The cord lock typically resembles a pyramid with a flat top such that the base is larger than the top. It could, however, be formed into any shape to make it more marketable or applicable to a specific cord locking application. In this version the front and rear exterior sides, 72*a* and 72*b*, run parallel with the slit and are longer than the right and left exterior ends, 74*a* and 74*b*, which are perpendicular to the slit. The front and rear exterior sides, 72*a* and 72*b*, have an upward convex surface designed to fit the fingers. The right and left exterior ends, 74*a* and 74*b*, have a similar convex upward curve with the addition of an inward convex curve designed to fit the finger tips.

Figure 2A:
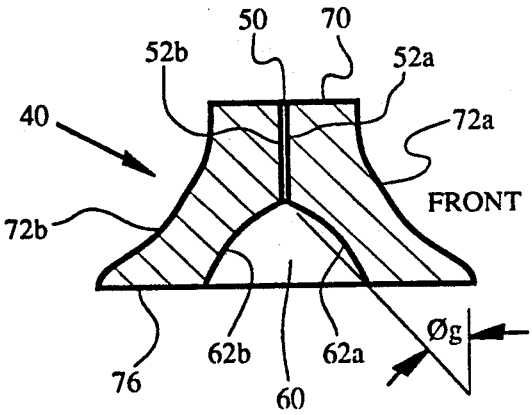
FIG. 2A—Side cross-sectional view of FIG. 2.

FIG. 2A shows FIG. 2 in side cross-section along cut 2A—2A. In this view it can be seen that the cord lock body, 40, is of unitary construction and preferably made out of one material, such as an injection molded thermoplastic. Ideally, this material should have a high coefficient of surface friction with the cord material, be highly resistant to tearing, and remain resilient through a temperature range of −20° C. to 55° C. The cord lock body could also be made with a combination of materials with differing physical properties, as in flow molding or lamination. The slit, 50, defines the cord gripping surfaces which are shown as front and rear side walls, 52*a* and 52*b*. Approximately halfway down the interior of the cord lock, the slit walls diverge forming a cavity, 60, with a large opening in the bottom exterior surface, 76. The front and rear interior side walls of the cavity, 62*a* and 62*b*, roughly parallel the exterior side walls but can have any type of curvature or angle $\phi g$.

Figure 2B:
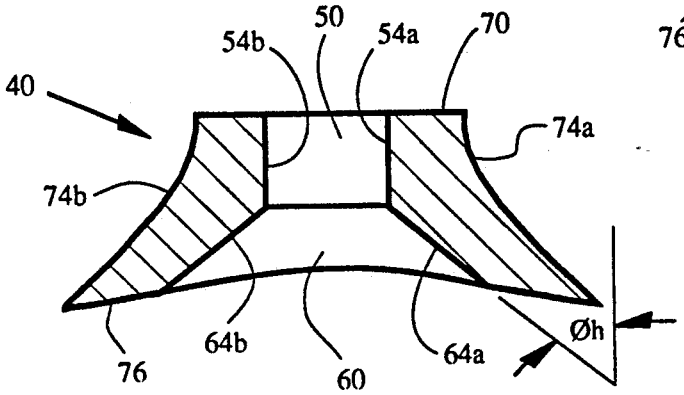
FIG. 2B—Front cross-sectional view of FIG. 2.

FIG. 2B shows FIG. 2 in front cross-section along cut 2B—2B showing the slit, 50, and again expanding into the cavity 60. The opposing interior right and left end walls of the slit, 54*a* and 54*b*, run vertically and should have a rounded concave surface to prevent stress concentrations which might cause the material of the cord lock body to tear. The right and left end walls of the cavity, 64*a* and 64*b*, run roughly parallel to the right and left exterior end walls, 74*a* and 74*b*, but again can have any type of curvature or angle, $\phi h$, but should be such that they smoothly direct the laces up into the slit. The top exterior surface, 70, is shown flat, but it can be of any surface configuration, for example, dome or cone shaped. The bottom exterior surface, 76, is curved to match the top contour of the shoe, but can be of any surface configuration, as was suggested for the top surface.

Figure 6:
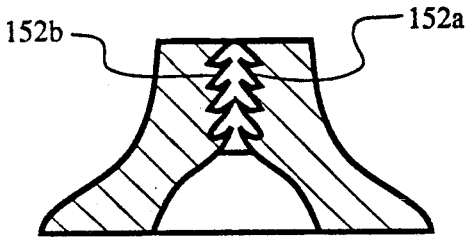
FIG. 6—Side cross-sectional view showing an alternate embodiment of the cord lock where surface protrusions have been formed in the slit walls.

FIG. 6 shows in side cross-section an alternate embodiment where the slit side walls, 152*a* and 152*b*, have surface protrusions such as teeth, ribs, a knurled surface, etc. molded into them.

Figure 7:
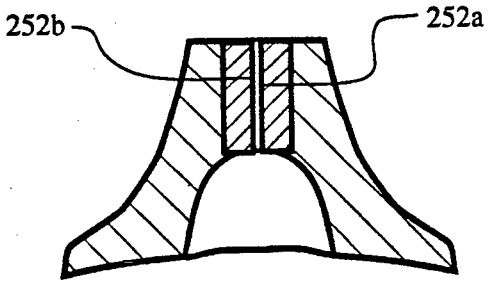
FIG. 7—Side cross-sectional view showing an alternate embodiment of the cord lock where a laminate of different material has been used to line the walls of the slit.

FIG. 7 shows in side cross-section another alternate embodiment where the slit side walls, 252*a* and 252*b*, are laminated with a different material than that of the body of the cord lock. This laminate could also have surface protrusions formed in it as in FIG. 6.

Figure 8:
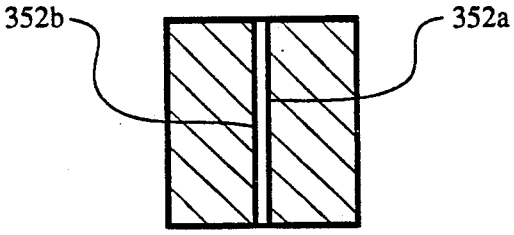
FIG. 8—Side cross-sectional view showing an alternate embodiment of the cord lock where the body has been reduced to its simplest form, a block with a slit through the center.

FIG. 8 shows the simplest alternate embodiment in side cross-section where the cord lock is simply a block of the body material with a slit through the center. The front and rear walls of the slit, 352*a* and 352*b*, run evenly through the entire height of the cord lock body.

Figure 9:
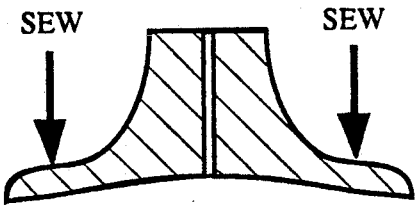
FIG. 9—Top perspective view showing an alternate embodiment of the cord lock where the base has been flared out into a thin platform so that it can be sewn to fabric.

FIG. 9 shows an alternate embodiment in side cross-section where the base of the cord lock is expanded to a thin platform. This will allow a needle and thread to pass through the body material and sew the cord lock onto a piece of material, such as fabric.

Figure 10:
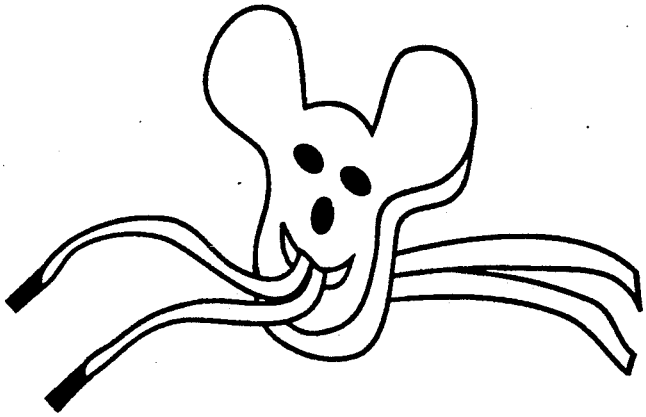
FIG. 10—Top perspective view showing an alternate embodiment of the cord lock where the exterior has been molded into a figure.

FIG. 10 shows a top perspective of an alternate embodiment where the body of the cord lock has been molded into a face. The body could be molded into any figure necessary to increase its market appeal, such as corporate logos or the faces of endearing characters.

OPERATION OF THE INVENTION

(FIGS. 1, 3, 3A, 4, 4A, 5, 5A, 6, 7, 8, 9)

Figure 3:
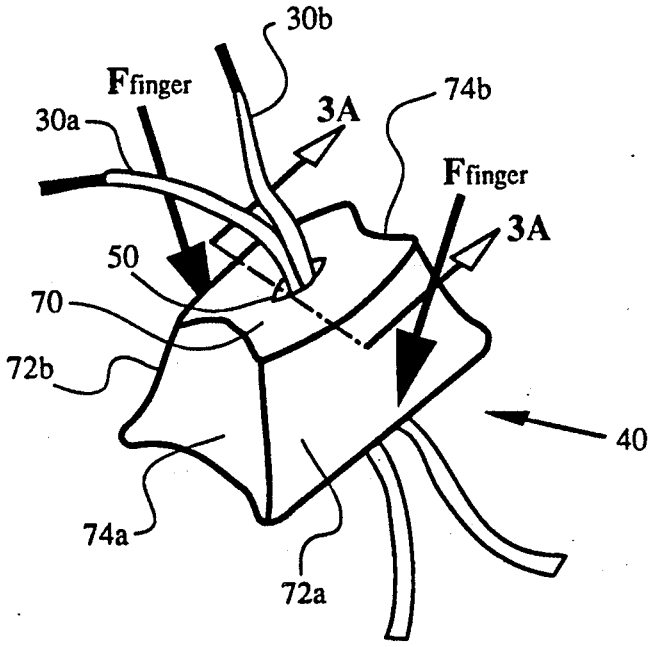
FIG. 3—Top perspective showing the slit spread open, thus releasing the shoelace ends, resulting from pushing on the front and rear exterior sides of the base with the thumb and forefinger.
Figure 3A:
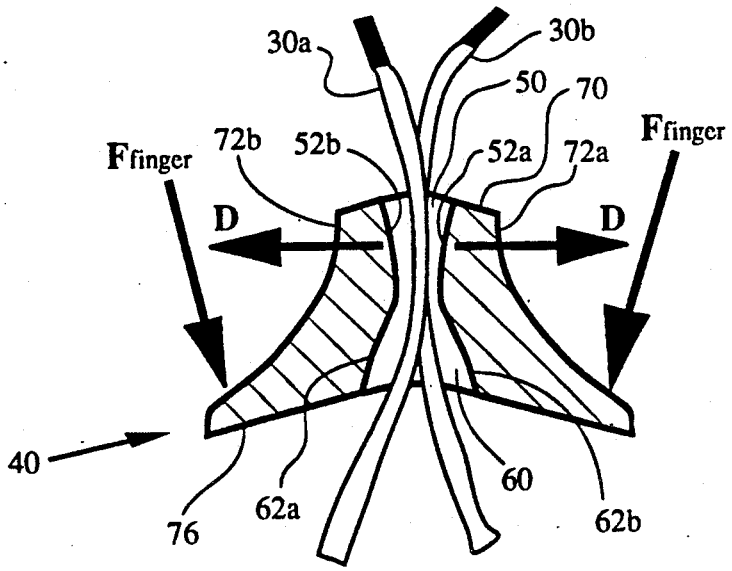
FIG. 3A—Side cross-sectional view of FIG. 3 showing the spreading of the slit.

The cord lock is operated as follows: Referring to FIG. 3, first the laces are threaded through the slit, 50, of the cord lock going in the bottom and out the top. At this time the shoe should be tightened onto the foot using the laces. Next the lace ends, 30*a* and 30*b*, are grasped and held taut by one hand to prevent the shoe from loosening up, while the thumb and forefinger of the other hand are placed on the front and rear exterior side walls of the body, 72*a* and 72*b*. The cord lock, 40, is then pushed down the laces toward the shoe, 20, with this hand while the other hand keeps the laces in tension to prevent the shoe from loosening and to facilitate the pushing of the cord lock towards the shoe. It can be seen in FIG. 3A that the pushing force occurs at the base of the front and rear exterior side walls 72*a* and 72*b*, due to their convex curvature. The pushing force, as represented by the force vector $F_{finger}$, simultaneously applied at these points causes the resilient body of the cord lock, 40, to compress into the cavity, 60, in the lower half of the body. This in turn causes the opposing interior front and rear side walls of the slit 52*a* and 52*b*, to spread apart as represented by the displacement vector D, thus leaving a gap through which the laces can easily slide. The bottom edge of the slit might require a configuration for preventing the cord from getting pinched at this point, such as a notch or groove. The cord lock, 40, is then easily slid down the laces until the bottom surface of the cord lock base, 76, is pressed firmly against the top of the shoe. Refer to FIG. 1 to see the cord lock in its final position.

Figure 4:
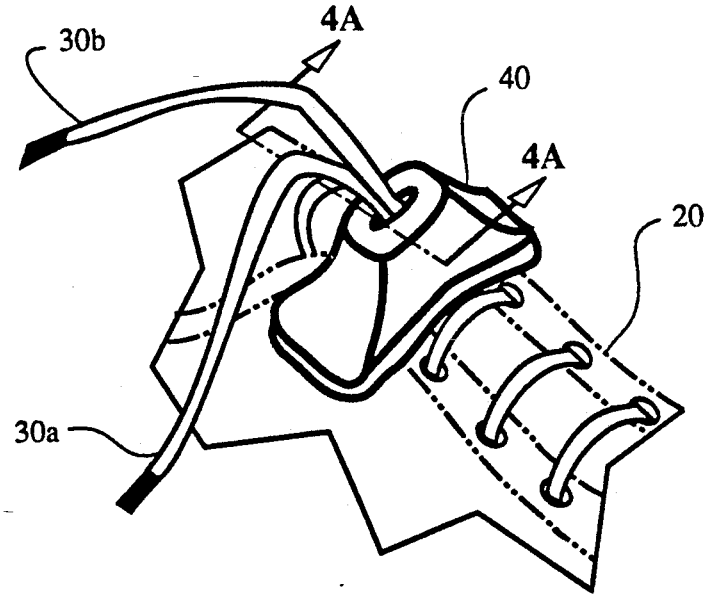
FIG. 4—Top perspective showing locking of the cord lock onto laces of the shoe with the shoelace ends threaded through the slit.
Figure 4A:
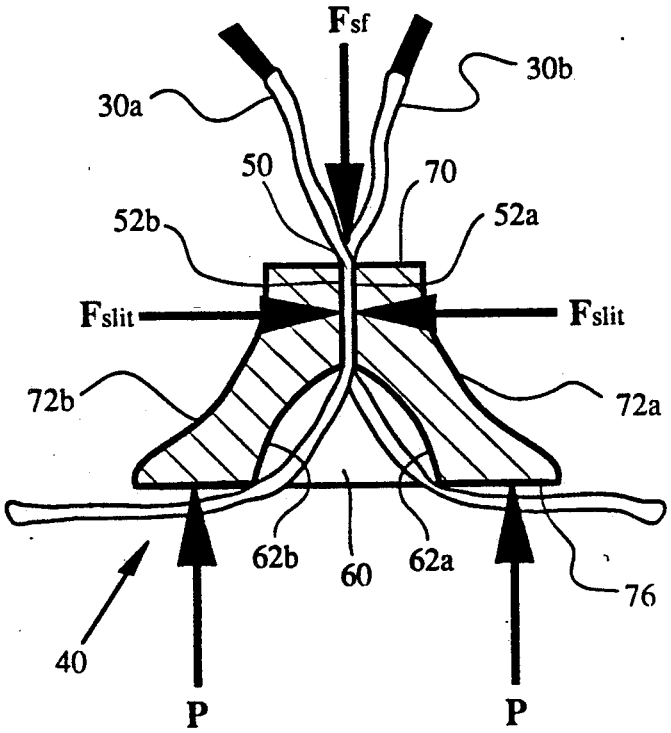
FIG. 4A—Cross-sectional view of FIG. 4 showing the slit clamping down and grabbing onto the shoelaces, resulting from the upward pressure from the shoe against the bottom side of the lock.

Referring to FIG. 4A, which is a side cross-section of FIG. 4, the locking action of the cord lock is depicted. The section of laces between the gripping slit and the last eyelet of the shoe exerts a pressure, P, against the bottom surface of the cord lock base, 76. An equal and opposite force, $F_{sf}$, acts at the slit, 50, which is a result of the surface friction between the walls of the slit, 52*a* and 52*b*, and the material of the lace ends, 30*a* and 30*b*. Because the base is wider than the slit, $F_{sf}$ and P are not in line and so moments are created on each side of the slit. These moments are balanced by equal and opposite forces, $F_{slit}$, acting at the slit. This creates a clamping effect at the slit. This means that the harder the cord lock is pushed against the shoe the harder it locks onto the laces.

Figure 5:
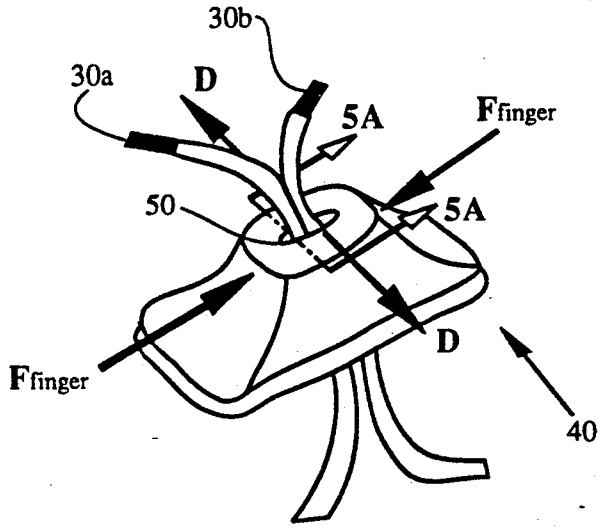
FIG. 5—Top perspective showing releasing of the cord lock from the laces of the shoe, with the slit spread open, thus releasing the shoelace ends, resulting from squeezing pressure applied by fingers to the sides of the cord lock body.
Figure 5A:
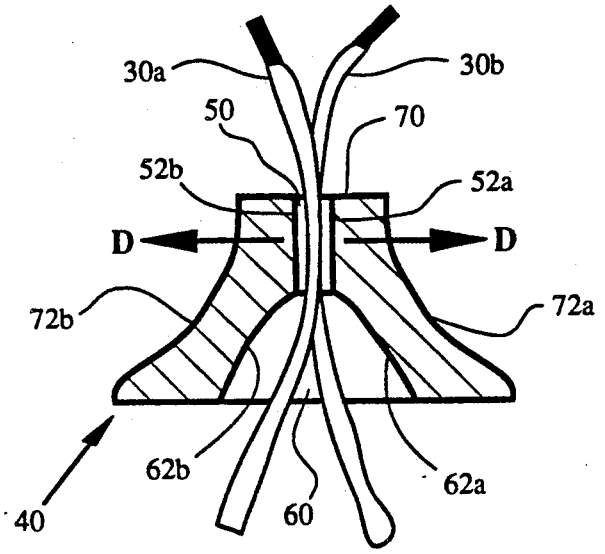
FIG. 5A—Side cross-sectional view of FIG. 5 showing the released shoelace ends.

To release the cord lock device 40 from its lock condition of FIGS. 4 and 4A in which the slit side walls 52*a* and 52*b* assume a substantially closed unpuckered configuration in which the gripping surfaces of side walls securely hold the cord, the thumb and forefinger are used to squeeze the right and left exterior end walls, 74*a* and 74*b*, as is represented in FIG. 5 by $F_{finger}$. These ends are curved, as described earlier, to provide a comfortable and sturdy gripping surface for the fingers and thus facilitate this action. When the body of the cord lock, 40, is squeezed between these two fingers it causes the slit side walls, 52*a* and 52*b*, to assume a substantially opened puckered configuration with the gripping surfaces of the side walls bowing away from one another and thus spread apart as shown in FIG. 5A by the displacement vectors, D. This releases the grip on the shoelace. The cord lock can then be pulled away from the shoe with the same hand that is squeezing the body. The shoe can now be removed from the foot.

FIG. 6 is an alternate embodiment with the intention of increasing the surface friction between the slit side walls, 152*a* and 152*b*, and the cord by molding surface protrusions such as teeth, ribs, a knurled surface, etc., into the slit side walls. This added gripping action might be necessary for certain heavy duty cord applications.

FIG. 7 is another alternate embodiment with the intention of increasing the surface friction and/or the durability of the slit side walls, 252*a* and 252*b*. This would be accomplished by laminating a different material, such as a different density thermoplastic, vinyl, rubber, or metal, to the side walls of the slit. While these materials might provide better gripping action and/or wear properties to the slit side walls, they would probably not be suitable for use as a body material due to improper resiliency characteristics. The slit laminates could also have surface protrusions formed into them for the purpose of increasing the surface friction between the slit side wall and cord as was described in FIG. 6.

FIG. 8 is an alternate embodiment to demonstrate the simplest, although not the preferred, configuration of the cord lock. This is simply a block of the body material with a slit through the center to form the gripping surfaces, 352*a* and 352*b*, that lock onto the cord. Operation is the same as the previous description, with the exception of tightening the cord lock. In this case, because there is no hollow section in the base of the body into which the body can collapse and release the slit at the top, this cord lock must be released by squeezing the body at the ends of the slit to pucker the slit open. This action must be used for both applying and releasing the cord lock.

SUMMARY, RAMIFICATIONS, AND SCOPE

Accordingly, the reader will see that the cord lock of this invention can be used to quickly, easily, and securely engage one or more cords and hold them in place. Because it only requires a simple finger pushing or squeezing action to tighten or release the lock, it can be quickly and easily adjusted after it was initially tightened down. This adjustment can even be done while the article is in use. Furthermore, once tightened down the cord lock will not loosen up due to the clamping action created by the pressure of the article acting against the cord lock.

Additional advantages inherent to the cord lock's unitary construction of resilient material are:

minimal production costs;

enhanced durability due to the lack of wear points such as hinges, joints, articulating or moving surfaces;

comfortable to use;

aesthetically pleasing due to the wide array of shapes and colors into which it can be molded;

can be easily sewn or attached to fabric or other materials to provide unique cord locking applications.

Additionally, the cord lock can be made to meet specific cord locking needs by varying the material used in its body, and/or laminating and changing the surface configuration of the cord gripping slit.

Although the description above contains many specificities, these should not be construed as limiting the scope of the invention, but as merely providing illustrations of some of the presently preferred embodiments of this invention. For example, the body can take on any exterior shape in which it can be formed, the slit can have any interior surface or configuration necessary to facilitate its gripping action on the cord, the hollow at the base of the body can assume any shape necessary to assist its function in releasing the slit and guiding the cords up into the slit.

Thus the scope of the invention should be determined by the appended claims and their legal equivalents, rather than by the examples given.

What is claimed is:

1. A cord lock device for securely engaging a cord, said device comprising:

(a) an elastic, resilient body having an exterior and a substantially solid interior, said body also having a pair of generally opposite top and bottom exterior surface portions, a pair of generally opposite front and rear side exterior surface portions, and a pair of generally opposite right and left end exterior surface portions;

(b) said body further having a slit extending through said substantially solid interior of said body between said opposite top and bottom exterior surface portions thereof to form a passageway for receiving a cord through said body, said slit being defined by a pair of opposing interior right and left end walls spaced inwardly from said opposite right and left end exterior surface portions of said body and a pair of opposing interior front and rear side walls spaced inwardly from said opposite front and rear side exterior surface portions of said body;

(c) said opposing interior front and rear side walls and said opposing interior right and left end walls extending between said opposite top and bottom exterior surface portions of said body and said opposing interior right and left end walls extending between and interconnecting respective opposite ends of said opposing interior front and rear side walls such that said substantially solid interior of said body completely surrounds said passageway defined by said slit with the cord received therethrough extending from said opposite top and bottom exterior surface portions of said body;

(d) said opposing interior front and rear side walls of said slit including gripping surfaces thereon being capable of engaging and gripping and thereby securely holding the cord extending through said passageway;

(e) said opposing interior front and rear side walls of said slit having respective widths extending between said opposing interior right and left end walls of said slit that are substantially longer than respective widths of said opposing interior right and left end walls of said slit extending between said opposing interior front and rear side walls of said slit such that application of inwardly directed pressure at said opposite right and left end exterior surface portions of said body will cause said opposing interior right and left end walls of said slit to move toward one another and said opposing interior front and rear side walls of said slit to move away from one another to thereby cause said slit to deform from a substantially closed unpuckered configuration in which said gripping surfaces of said opposing interior front and rear side walls securely hold the cord, to a substantially opened puckered configuration in which the cord, being held securely by said gripping surfaces, is released for permitting moving of said body relative to the cord.

2. The cord lock device of claim 1 wherein said solid interior of said body surrounding said passageway defined by said slit is of unitary construction.

3. The cord lock device of claim 1 wherein said opposing interior front and rear side walls of said slit in said closed unpuckered configuration thereof extend substantially parallel to one another.

4. The cord lock device of claim 1 wherein said opposing interior front and rear side walls of said slit in said opened puckered configuration thereof are bowed away from one another.

5. The cord lock device of claim 1 wherein said gripping surfaces on said opposing interior front and rear side walls of said slit have protrusions formed thereon for gripping the cord.

6. The cord lock device of claim 1 wherein said body includes a pair of interior laminate portions defining said gripping surfaces of said opposing interior front and rear side walls of said slit.

7. The cord lock device of claim 6 wherein said gripping surfaces on said opposing interior front and rear side walls of said slit defined by said pair of interior laminates have protrusions formed thereon for gripping the cord.

8. The cord lock device of claim 1 wherein said body has a lower base defining a hollow cavity expanding from and extending below said passageway defined by said slit such that the cord received through said passageway will extend through said hollow cavity and said gripping surfaces will substantially release the cord by squeezing inwardly on said base of said body against said opposite front and rear side exterior surface portions of said base of said body.

9. The cord lock device of claim 8 wherein said base of said body has a pyramidal shape such that pressure applied to a bottom of said base produces increased gripping action of said slit on said cord.

10. The cord lock device of claim 9 wherein said hollow cavity formed in said base has a pyramidal shape.

11. In combination with an article having at least one cord, a cord lock device for securely engaging said cord, said device comprising:

(a) an elastic, resilient body having an exterior and a substantially solid interior, said body also having a pair of generally opposite top and bottom exterior surface portions, a pair of generally opposite front and rear side exterior surface portions, and a pair of generally opposite right and left end exterior surface portions;

(b) said body further having a slit extending through said substantially solid interior of said body between said opposite top and bottom exterior surface portions thereof to form a passageway for receiving said cord through said body, said slit being defined by a pair of opposing interior right and left end walls spaced inwardly from said opposite right and left end exterior surface portions of said body and a pair of opposing interior front and rear side walls spaced inwardly from said opposite front and rear side exterior surface portions of said body;

(c) said opposing interior front and rear side walls and said opposing interior right and left end walls extending between said opposite top and bottom exterior surface portions of said body and said opposing interior right and left end walls extending between and interconnecting respective opposite ends of said opposing interior front and rear side walls such that said substantially solid interior of said body completely surrounds said passageway defined by said slit with said cord received therethrough extending from said opposite top and bottom exterior surface portions of said body;

(d) said opposing interior front and rear side walls of said slit including gripping surfaces being capable of engaging and gripping and thereby securing holding said cord extending through said passageway;

(e) said opposing interior front and rear side walls of said slit having respective widths extending between said opposing interior right and left end walls of said slit that are substantially longer than respective widths of said opposing interior right and left end walls of said slit extending between said opposing interior front and rear side walls of said slit such that application of inwardly directed pressure at said opposite right and left end exterior surface portions of said body will cause said opposing interior right and left end walls of said slit to move toward one another and said opposing interior front and rear side walls of said slit to move away from one another to thereby cause said slit to deform from a substantially closed unpuckered configuration in which said gripping surfaces of said opposing interior front and rear side walls securely hold said cord, to a substantially opened puckered configuration in which said cord, being held securely by said gripping surfaces, is released for permitting moving of said body relative to said cord.

12. The combination of claim 11 wherein said solid interior of said body surrounding said passageway defined by said slit is of unitary construction.

13. The combination of claim 11 wherein said opposing interior front and rear side walls of said slit in said closed unpuckered configuration thereof in the absence of said cord extend substantially parallel to one another.

14. The combination of claim 11 wherein said opposing interior front and rear side walls of said slit in said opened puckered configuration thereof are bowed away from one another.

15. The combination of claim 11 wherein said gripping surfaces of said opposing interior front and rear side walls of said slit have protrusions formed thereon for gripping said cord.

16. The combination of claim 11 wherein said body includes a pair of interior laminate portions defining said gripping surfaces of said opposing interior front and rear side walls of said slit.

17. The combination of claim 16 wherein said gripping surfaces of said opposing interior front and rear side walls of said slit defined by said pair of interior laminates have protrusions formed thereon gripping said cord.

18. The combination of claim 11 wherein said body has a lower base defining a hollow cavity expanding from and extending below said passageway defined by said slit such that said cord received through said passageway extends through said hollow cavity and said gripping surfaces will substantially release said cord by squeezing inwardly on said base of said body against said opposite front and rear side exterior surface portions of said base of said body.

19. The combination of claim 18 wherein said base of said body has a pyramidal shape such that pressure applied to a bottom of said base produces increased gripping action of said slid on said cord.

20. The combination of claim 18 wherein said hollow cavity formed in said base has a pyramidal shape.

* * * * *